US007122107B2

(12) United States Patent
Kia et al.

(10) Patent No.: US 7,122,107 B2
(45) Date of Patent: Oct. 17, 2006

(54) COLOR STABILIZATION OF ANODIZED ALUMINUM ALLOYS

(75) Inventors: Sheila Farrokhalaee Kia, Bloomfield Hills, MI (US); Hong-Hsiang Kuo, Troy, MI (US); Yar-Ming Wang, Troy, MI (US)

(73) Assignee: General Motors Corporation, Detroit, MI (US)

( * ) Notice: Subject to any disclaimer, the term of this patent is extended or adjusted under 35 U.S.C. 154(b) by 341 days.

(21) Appl. No.: 10/650,204

(22) Filed: Aug. 28, 2003

(65) Prior Publication Data

US 2005/0045487 A1 Mar. 3, 2005

(51) Int. Cl.
*C25D 11/18* (2006.01)
*C25D 11/22* (2006.01)

(52) U.S. Cl. ..... 205/173; 205/224; 205/229

(58) Field of Classification Search ..... 205/224, 205/229, 173

See application file for complete search history.

(56) References Cited

U.S. PATENT DOCUMENTS 4,209,569 A * 6/1980 Brugger ..... 428/472
5,277,982 A * 1/1994 Jozefowicz ..... 428/409
5,324,587 A * 6/1994 Nitowski et al. ..... 428/469
5,392,695 A * 2/1995 Junkel ..... 99/328

* cited by examiner

*Primary Examiner*—Roy King
*Assistant Examiner*—William T. Leader
(74) *Attorney, Agent, or Firm*—Kathryn A. Marra

(57) ABSTRACT

A process is disclosed for stabilizing certain colored anodized coating on aluminum articles against degradation by ultraviolet radiation. Anodized articles colored by an electrolytic or interference process can thereafter be stabilized by heat treating them at temperatures of the order of 350° F. for a period of an hour or so. The process is particularly useful for use on electrolytically colored, anodized vehicular external body panels made from suitably formable sheet metal aluminum alloys.

8 Claims, 2 Drawing Sheets

COLOR STABILIZATION OF ANODIZED ALUMINUM ALLOYS

TECHNICAL FIELD

This invention pertains to the coloring of anodized aluminum or aluminum alloy articles. More particularly, this invention pertains to the stabilization of colored anodized aluminum articles against degradation of the coloring materials by ultraviolet radiation.

BACKGROUND OF THE INVENTION

There are known practices for the anodization of surfaces of aluminum and aluminum alloy articles. Depending upon the intended use of the article it may be anodized for corrosion resistance, wear resistance and/or appearance. The surface of the article is cleaned and pretreated in preparation for anodization. There are many anodization practices, but in general the article is immersed as an anode in an aqueous electrolyte comprising an acid such as sulfuric acid. Anodization processes for producing colored or colorable anodized layers are often conducted with an electrolyte bath with a temperature of about 25° C. The passage of an electrical current, usually direct current, through the bath produces an adherent coating on the aluminum surface of closely spaced, crystalline columns of aluminum oxide. The resulting columnar coating is a result of competing chemical reactions between the electrolyte and the aluminum surface. The electrochemical effect is to oxidize aluminum atoms at the workpiece surface to $Al_2O_3$ which build-up on the surface as thin polygonal columns of the oxide with a vertical axial pore. Coincident with the oxidation of the aluminum surface atoms, the acid electrolyte tends to soften and dissolve the aluminum oxide columns. An exemplary thickness of the anodized oxide columns is about fifteen micrometers.

In some instances the composition of the aluminum alloy is such that the anodized layer is colored as formed. Some aluminum alloys, such as certain magnesium containing alloys, yield anodized layers that are grey or even black when anodized in a sulfuric acid electrolyte. Other aluminum alloys yield different colors. Sheets of these inherently colored, anodized aluminum alloys are useful for decorative purposes in architectural and building applications. Still other aluminum alloys yield clear anodized coatings that can be colored by dying or by electrolytic deposition of metal particles.

Recently, automotive vehicle body panels have been formed of sheet metal aluminum alloys and they have been painted to match other body surfaces. However, there is an interest in anodizing and coloring such aluminum alloy surfaces. But automotive outer surfaces are continually exposed to the color degrading effects of the ultraviolet portion of solar radiation. Most dyes used in coloring anodized surface quickly fade during prolonged exposure to sunlight and are unsuitable for vehicular external applications. The coloring effect of metal particles deposited in the pores of the alumina columns is more durable than typical dyes but still fades to an unacceptable degree.

Accordingly, it is an object of this invention to provide a method of stabilizing the color of anodized aluminum coating against degradation by ultraviolet radiation.

SUMMARY OF THE INVENTION

This invention provides a method of treating an electrolytically colored, anodized aluminum alloy article against degradation of the color by sun light. Following the deposition of the coloring particles in the pores of the anodized coating the article is heated to a temperature above about 300° F. for a time sufficient to stabilize the color finishes.

The color characteristics of a newly colored anodized workpiece can be quantitatively determined by a calorimeter or the like. It is found that exposure of such a workpiece to intense ultraviolet radiation results in a substantial loss of color intensity or change in color, particularly in the initial period of exposure to the UV radiation. It is believed that this initial color change may be attributed to aging of hydrated material associated with the oxide layer and/or the electrolytically deposited metal particles. The porous anodized layer of crystalline aluminum oxide columns are formed from an acidic electrolyte such as aqueous sulfuric acid. The electrolytic deposition of the coloring particles is also accomplished using an aqueous acid bath containing a salt of the coloring metal. Either process can form hydrates associated with the aluminum oxide or the particles. Alteration or drying of the oxide by radiation could affect the color of the layer. It is now found that a suitable heat treatment of the newly formed article to age or dry the hydrate can significantly reduce later unwanted color loss or change. Whatever the mechanism, it is found that heating the colored workpiece to, for example, 350° F. for 60 minutes avoids or reduces the abrupt initial change in color upon exposure to sunlight.

The process has been demonstrated using aluminum sheet metal alloys such as AA5083, 5657 and 6111, which have been anodized in an aqueous sulfuric acid electrolyte bath and then colored in a tin sulfate/sulfuric acid electrolyte to produce workpiece specimens with a decorative bronze color. Both plain electrolytic coloring and pore widening interference coloring of nominally 15 micrometer thick anodized layers were obtained. After sealing of the surfaces, the colored specimens were heated at 350° F. for 60 minutes. Exposure to the intense UV radiation of a Xenon lamp yielded only a gradual fading of the color. There was no abrupt immediate degradation such as what is experienced with un-heat treated samples anodized and colored by the same processes.

Thus, the process of this invention provides a way of producing color stable, decorative formed and anodized articles such as exterior body panels for automotive vehicles.

Other objects and advantages of the invention will be apparent from detailed descriptions of specific embodiments which follow.

DESCRIPTION OF PREFERRED EMBODIMENTS

Figure 1:
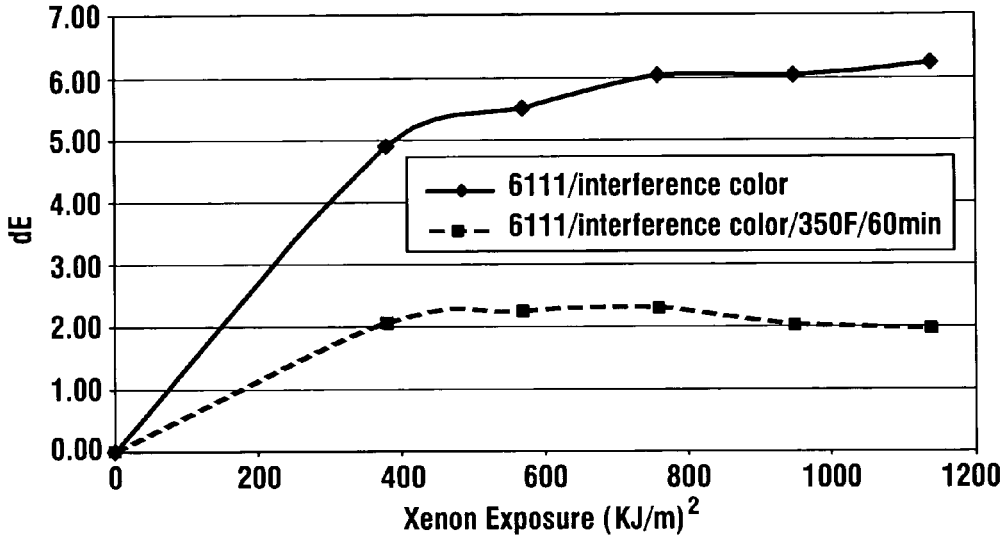
FIG. 1 is a graph summarizing the color change (dE) from anodized AA6111 sheet surface samples that have been electrolytically (interference) colored using a stannous sulfate/sulfuric acid electrolyte, heated at 350° F. for 60 minutes and exposed to the UV radiation from a Xenon lamp (wavelength 280 to 340 nm) for increasing doses up to about 1200 $KJ/m^2$. Comparison samples of non-heat treated colored anodized specimens were also exposed to the radiation. The data is presented as a plot of dE versus Xenon exposure ($KJ/m^2$) for the heated sample (square data points) and unheated sample (diamond data points).

The practice of the invention will be illustrated by anodizing and coloring certain aluminum alloys for processing in accordance with this invention. Alloys were selected from those used in the formation of external body panels or trim for automotive vehicles. However, the practice of the invention is not limited to these alloys but it is generally applicable to colored anodized aluminum alloys.

Two of the exemplary alloys are AA5083 and AA5657. The third example is AA6111. The AA5XXX alloys are a series of aluminum base alloys that contain magnesium. The 5083 alloy is used in cold rolled sheet metal form for high elongation stretch forming of automotive body panels such as deck lids and door panels. This is an aluminum alloy that contains about 4% magnesium along with some manganese. Aluminum alloy 5657 is an alloy with less magnesium that has been used for bright trim pieces on automotive vehicles, but can also be used for making body panels. Aluminum alloy 6111 is an aluminum-based alloy containing magnesium and silicon and it is used in sheet metal form for stamping automobile body panels.

In preparation for anodizing small sheet metal sections of these alloys were cleaned in trisodium phosphate for five minutes at 60° C. and rinsed in water. The cleaned specimens were etched in sodium hydroxide solution for five minutes at 60° C. and rinsed and then de-smutted (deoxidized) in nitric acid solution for one minute with a water rinse.

The several sheet metal aluminum alloy samples were anodized in aqueous sulfuric acid electrolyte under conditions to produce clear anodized coatings that were about 15 micrometers in thickness. The electrolyte bath for anodizing contained about 165 grams of sulfuric acid per liter of bath. The respective aluminum alloy workpieces were arranged as anodes in the bath with stainless steel cathode bars. The anodization was conducted at a temperature of about 25° C. and 16 volts direct current for several minutes until the desired clear coat anodized thickness was obtained. A current density of about 12–15 amperes per square foot was employed for the respective samples except for the AA5083 samples. In the case of the AA5083 samples the high magnesium content tended to produce a dark un-colorable anodized layer and a current density of only about 5 amperes per square foot was employed. Following anodization, the samples were rinsed. Thus, each of the AA 5083, 5657 and 6111 sheet samples were provided with a layer of a dense porous coating of columnar crystals of aluminum oxide. These anodized coatings, about fifteen micrometers thick, were to be colored by the electrolytic deposition of coloring metal particles in the pores.

Some of the anodized aluminum alloy samples were colored by a, more or less, standard electrolytic coloring process using a tin sulfate solution. The bath was made up to contain 15 grams of tin (as stannous sulfate) per liter of bath, 15 grams of sulfuric acid per liter of bath and a stabilizing agent. The bath had a pH of about 1. The electrolytic coloring was preformed at an ambient temperature of about 25° C. with the workpieces arranged as cathodes for the direct current portion of the coloring process.

The workpieces were immersed in the bath for about 60 seconds to allow the aqueous electrolyte to penetrate the pores of the clear anodic coating. The workpieces were then pre-treated in the bath at 8 volts direct current for 60 seconds. The coloring was then affected by applying an alternating current power source to the workpieces with the voltage cycling at 60 hertz, between +4 volts and −9 volts. This alternating current coloring was continued for 15 seconds. During the cathodic portion of the AC cycling small particles of tin were formed from the electrolyte in the pores of the coating and deposited there to provide each of the respective sample layers with a bronze color.

The colored anodized parts were then rinsed and immersed in a nickel fluoride sealing bath at ambient temperature for 15 minutes. Finally the parts were removed from the ambient sealing bath and sealed again with hot water for 15 minutes at 70° C.

Other samples of the respective anodized aluminum alloy sheet specimens were colored by a variation of above described electrolytic coloring process to produce an interference-type coloring. This coloring process was similar to the above-described process in that tin sulfate in a sulfuric acid electrolyte was employed for the coloring process but the samples were pretreated to somewhat enlarge the pores in the clear coating of columnar aluminum oxide crystals before the deposit of the coloring tin particles. After anodizing the samples to be interference colored were immersed in an aqueous sulfuric acid bath for a few minutes at a direct current voltage less than the anodizing voltage. The conditions were selected to enlarge the pores of the existing porous anodized layer rather than growing the existing layer. As is known, the larger pores provide a larger cavity for the internal reflection of light from deposited coloring particles. The pretreated anodized samples were then electrolytically colored in an acidic tin sulfate bath as described above.

The interference colored aluminum alloy specimens were also sealed in a room temperature nickel fluoride bath followed by a hot water seal for 15 minutes at 70° C.

These electrolytic and interference colored samples each had attractive colored surfaces that would be pleasing on an external body surface of an automotive vehicle. However, experience has shown that the color will fade quickly upon exposure to sunlight. In accordance with this invention, it is found that suitable heating of the colored anodized workpieces is effective in stabilizing the colored surfaces against color change when the surface is exposed to intense ultraviolet radiation. It is not known exactly how the heating stabilizes the color. But it is believed that if sufficient heat is applied residual water in the pores of the anodized coating is removed and the pigment containing anodized layer is otherwise aged or stabilized so that there is less degradation in color by subsequent exposure of ultraviolet light. As will be shown in the subsequent description of experiments below heating at 350° F. for 60 minutes markedly stabilizes the colored anodized samples. It is likely that a heating regimen at a lower temperature would also be suitable.

As stated representative samples of electrolytically and interference colored anodized aluminum alloys were heated at 350° F. for sixty minutes to stabilize and age the colored coating. These samples and corresponding un-treated samples were exposed to the UV radiation of a Xenon lamp (wavelength, 280 to 340 nanometers) for increasing periods of exposure up to about 1200 KJ/$m^2$. The initial color of the specimens and the color changes in the specimens due to the UV radiation were measured in a CIELAB™ colorimeter.

The CIELAB™ colorimeter is an opponent color system in which color from a source is translated into distinctions between light and dark, red and green, and blue and yellow. In an analysis of a colored specimen, the CIELAB instrument indicates these values with three data axes: L*, a* and b*. The central vertical axis represents lightness, signified as L*, whose values run from 0 (black) to 100 (white). Two orthogonal horizontal axes represent color. They are based on the fact that a color can't be both red and green, or both blue and yellow, because these colors oppose each other. On each axis the values run from positive to negative. On the a–a' axis, positive values indicate amounts of red while negative values indicate amounts of green. On the b–b' axis, yellow is positive and blue is negative. For both axes, zero is neutral gray.

Thus the color analysis of a particular specimen has a color characterized by specific values of L*, a*, and b*. For purposes of considering changes in the color of a specimen, for example, before and after exposure to a known energy of UV radiation, the following computation involving the changes in the three characteristic values may be made:

$$dE=\sqrt{(\Delta L^*)^2+(\Delta a^*)^2+(\Delta b^*)^2}.$$

Figure 2:
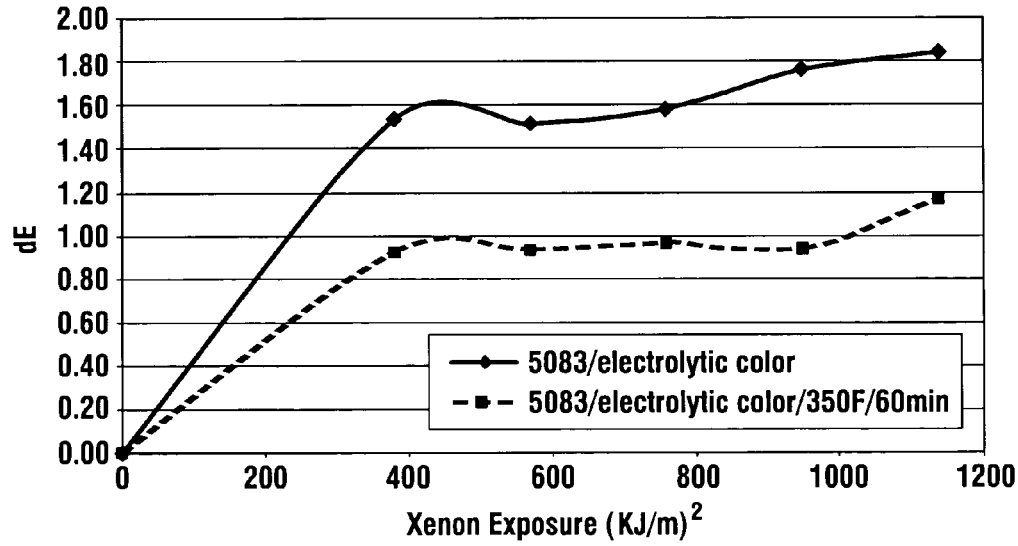
FIG. 2 is a graph, like FIG. 1, of color change data for heated and unheated electrolytic colored anodized AA5083 sheet specimens.
Figure 3:
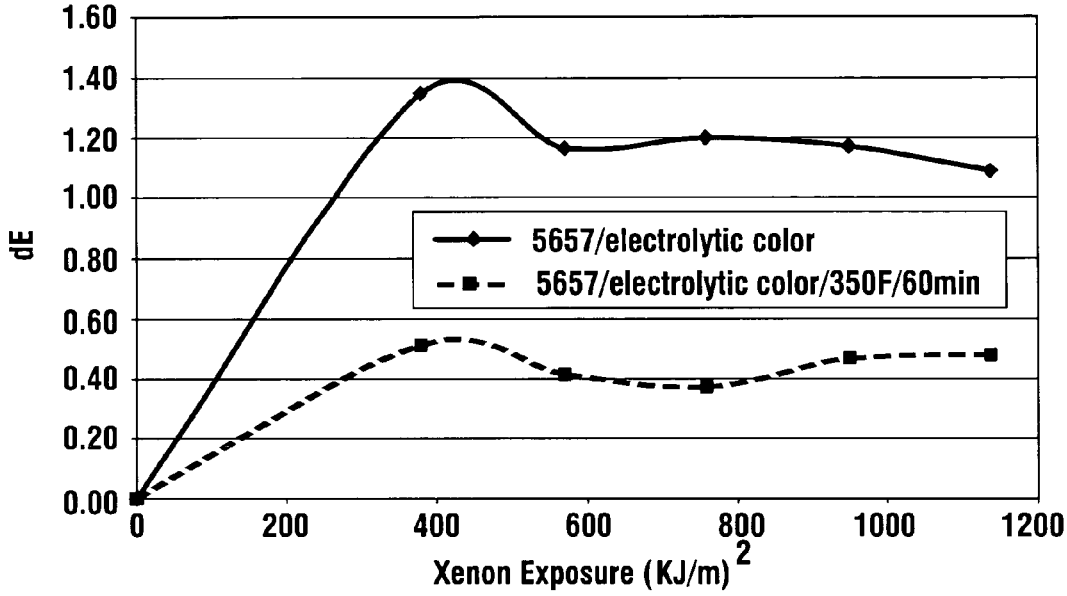
FIG. 3 is a graph, like FIG. 1, of color change data for heated and unheated electrolytic colored anodized AA5657 sheet specimens.

After initial color values were obtained, samples were removed after increasing periods of exposure to the high intensity lamp and color values again measured. This test is an accelerated test for determining color change attributable to exposure to sunlight and like weathering. FIGS. 1–3 summarize change in color (dE) for the different treated and untreated aluminum alloy sample after periods of UV exposure.

FIG. 1 is a graph of dE versus UV exposure in $KJ/m^2$ for tin sulfate interference colored AA6111 specimens. In FIG. 1, the filled diamond data points show the progressive increase in dE for the non-heat treated AA6111 interference color anodized comparison samples. The filled square data points are the dE values obtained from the AA6111 samples heat treated after anodizing and interference coloring in accordance with this invention. It is seen that the heat treatment markedly lowers the dE values of the samples produced by the invention.

FIG. 2 is a graph of dE values of heat-treated and non heat-treated AA5083 electrolytically color anodized samples. The filled diamond data points show the increase in dE for the AA5083 electrolytic color anodized comparison samples that were not heat-treated in accordance with this invention. The filled square data points are the dE values obtained from the AA5083 samples heated after anodizing and electrolytic coloring in accordance with this invention. It is seen that the heat treatment markedly lowers the dE values of the samples produced by the invention.

FIG. 3 is a graph of dE values of heat-treated and non heat-treated AA5657 anodized and electrolytically colored samples. The filled diamond data points show the increase in dE for the AA5657 anodized and colored comparison samples that were not heat-treated in accordance with this invention. The filled square data points are the dE values obtained from the AA5657 samples heated after anodizing and coloring in accordance with this invention. It is seen that the heat treatment markedly lowers the dE values of the samples produced by the invention.

Thus, the aging or stabilizing heat treatment of anodized and colored aluminum alloy samples markedly improves their resistance to color change or degradation by weathering. The practice of the invention has been illustrated by some specific examples but the scope of the invention is not intended to be limited by these illustrations.

The invention claimed is:

1. A method of making an external automotive vehicular aluminum alloy article having a colored anodized surface in which the color is stabilized against degradation by ultraviolet radiation, said method comprising:

anodizing said surface of said article in an aqueous sulfuric acid bath to form a colorable anodized layer on said surface, said layer being characterized by porous crystalline columns of aluminum oxide;

electrolytically depositing metal particles in the pores of said anodized layer for coloring said layer; and before said colored layer is exposed to color-degrading ultraviolet radiation, heating said colored layer at a temperature above 300° F. for a period sufficient to stabilize said color layer against said radiation; and, thereafter, incorporating said article into an automotive vehicle body where said colored layer will be exposed to ultraviolet radiation.

2. The method recited in claim 1 comprising sealing said colored layer before said heating step.

3. The method as recited in claim 1 in which said aluminum article is a sheet metal panel formed of an aluminum alloy of the AA5xxx series or AA6xxx series of alloy compositions and said heating period is in excess of 45 minutes.

4. A method of making an exterior automotive vehicular aluminum alloy sheet metal body panel having a colored anodized surface in which the color is stabilized against degradation by ultraviolet radiation, said method comprising:

forming said body panel from an aluminum alloy sheet material chosen for the forming of said panel;

anodizing said surface of said formed panel in an aqueous sulfuric acid bath to form a colorable anodized layer on said surface, said layer being characterized by porous crystalline columns of aluminum oxide and having a thickness of 15 micrometers or greater;

electrolytically depositing metal particles in the pores of said anodized layer for coloring said layer; and before said colored layer is exposed to color-degrading ultraviolet radiation, heating said colored layer at a temperature above 300° F. for a period sufficient to stabilize said color layer against said radiation; and, thereafter, incorporating said body panel into an automotive vehicle body where said colored layer will be exposed to ultraviolet radiation.

5. The method as recited in claim 4 in which said panel is formed of an aluminum alloy of the AA5xxx series of alloy compositions and said heating period is in excess of 45 minutes.

6. The method as recited in claim 4 in which said panel is formed of an aluminum alloy of the AA6xxx series of alloy compositions and said heating period is in excess of 45 minutes.

7. The method as recited in claim 4 in which said panel is formed of an aluminum alloy of the AA6111 composition and said heating period is in excess of 45 minutes.

8. The method as recited in claim 4 in which said panel is formed of an aluminum alloy of AA5083 or AA5657 composition and said heating period is in excess of 45 minutes.

* * * * *